US006299475B1

(12) United States Patent
Huspeni et al.

(10) Patent No.: US 6,299,475 B1
(45) Date of Patent: Oct. 9, 2001

(54) MODULAR IDC TERMINAL

(75) Inventors: Paul J. Huspeni, Keller; Richard B. Laporte, Ft. Worth; Elmer O. Freeman, Irving; Ziwei Liu, Ft. Worth; Antonio P. Rodriguez, Jr., Arlington, all of TX (US)

(73) Assignee: Corning Cable Systems LLC, Hickory, NC (US)

( * ) Notice: Subject to any disclaimer, the term of this patent is extended or adjusted under 35 U.S.C. 154(b) by 0 days.

(21) Appl. No.: 09/663,454

(22) Filed: Sep. 15, 2000

Related U.S. Application Data

(63) Continuation-in-part of application No. 09/089,585, filed on Jun. 3, 1998.

(51) Int. Cl.[7] ..... H01R 11/20
(52) U.S. Cl. ..... 439/412; 439/417
(58) Field of Search ..... 439/402, 403, 439/411, 412, 413, 701, 709, 715, 717, 850, 851

(56) References Cited

U.S. PATENT DOCUMENTS

| | | | | |
|---|---|---|---|---|
| Re. 35,476 | | 3/1997 | Levy | 439/411 |
| 3,042,895 | | 7/1962 | Bonhomme . | |
| 4,171,862 | | 10/1979 | Krasser . | |
| 4,533,195 | | 8/1985 | Knickerbocker . | |
| 4,580,864 | | 4/1986 | Knickerbocker . | |
| 4,652,071 | | 3/1987 | DeBortoli et al. . | |
| 4,682,835 | | 7/1987 | Aujla et al. | 439/395 |
| 4,741,480 | | 5/1988 | Despault et al. | 439/412 |
| 4,764,125 | | 8/1988 | Debortoli | 439/403 |
| 4,826,449 | | 5/1989 | Debortoli et al. | 439/411 |
| 4,854,899 | | 8/1989 | Matthews | 439/724 |
| 5,069,636 | | 12/1991 | Shimirak et al. | 439/412 |
| 5,102,347 | | 4/1992 | Cote et al. | 439/412 |
| 5,112,245 | | 5/1992 | Shimirak et al. | 439/412 |
| 5,167,526 | | 12/1992 | Pinyan et al. | 439/411 |
| 5,173,060 | | 12/1992 | Shimirak et al. | 439/416 |
| 5,288,251 | | 2/1994 | Sumida | 439/701 |
| 5,324,212 | | 6/1994 | Fremgen et al. | 439/412 |
| 5,449,299 | | 9/1995 | Shimirak et al. | 439/417 |
| 5,836,791 | * | 11/1998 | Waas et al. | 439/709 |
| 5,863,215 | * | 1/1999 | Debbaut et al. | 439/412 |
| 6,074,240 | * | 6/2000 | Bradshaw et al. | 439/412 |
| 6,093,050 | * | 7/2000 | Baum et al. | 439/412 |
| 6,099,343 | * | 8/2000 | Bonvallat et al. | 439/412 |
| 6,188,560 | * | 2/2001 | Waas | 439/412 X |
| 6,222,717 | * | 4/2001 | Waas et al. | 439/412 X |

* cited by examiner

*Primary Examiner*—Tulsidas Patel
*Assistant Examiner*—Son V. Nguyen

(57) ABSTRACT

A distribution terminal block for connecting individual drop wires to incoming telephone cable wires has a base that receives attachable modules. Each module has a pair of IDC clips. A plunger adapted for reciprocal movement within the module along a plunger axis presses the drop wires into engagement with the IDC clips. The module has a cavity filled with an electrically insulating gel. The plunger has an upper portion and a lower portion separated by a recess for receiving the drop wires. A spine connects the upper portion and the lower portion of the plunger. The lower portion has a smaller cross-sectional area than the upper portion and has an angled, sharp end for reducing disturbance to the insulating gel during movement of the plunger to insert, remove and reinsert the drop wires.

22 Claims, 4 Drawing Sheets

MODULAR IDC TERMINAL

CROSS-REFERENCE TO RELATED APPLICATIONS

This application is a continuation-in-part of U.S. patent application Ser. No. 09/089,585 filed Jun. 3, 1998.

FIELD OF THE INVENTION

This invention relates in general to electrical connectors and in particular to terminal blocks for connecting an incoming telephone cable to individual pairs of drop lines.

BACKGROUND OF THE INVENTION

Terminal blocks are commonly used in telephone distribution lines. For example, a telephone cable will lead from the telephone company system to a terminal block. The terminal block has a base with a number of connection stations, for example 10 to 15. Each station has a separate electrical connector that will connect one twisted-pair of wires in the incoming telephone cable to a pair of drop lines that leads to one of the telephones. The wires from the incoming telephone cable are pre-wired into the stations of the base. Each station has two holes for insertion of the two wires from one of the drop lines. Normally, the station will have an insulation displacement connector (referred to herein as "IDC") terminal registering with each of the holes. An IDC terminal allows the operator to insert the end of the drop line into the hole provided in the station without stripping the insulation from the drop line. The IDC terminal includes a clip having a slit with two sharp edges that are biased toward one another. The wire is pressed through the slit toward the base, thereby making electrical contact without the need for stripping the insulation from the wire.

When installing distribution terminals, it is not uncommon for the telephone company cable to have more capacity than will be initially required by the telephone drop lines. For example, the incoming cable may have a capacity for 15 pairs of drop lines, but only eight will be used initially, although it is possible in the future that the rest will be utilized. The company installing the distribution terminal may install a terminal block that has 15 separate stations to match the full capacity of the telephone company cable even though only eight pairs of drop lines are being used initially. Later, when the other stations are going to be used, the additional drop lines can simply be inserted into the stations. However, a larger terminal block than initially needed is more expensive. On the other hand, if the company elects to install a smaller terminal block, it may find that it later has to replace the smaller terminal block with a larger one.

It is not uncommon for a need to exist to remove drop wires from a module and then reinsert the same or different drop wires. The module housings are filled with an insulating gel to prevent water and other undesirable environmental effects from entering the housing and possibly shorting out the electrical connection. The insulating gel is a viscous substance that does not fully harden with time. It is important on reinsertion that the insulating gel flows around the drop wires and continues to properly encapsulate the drop wires and the IDC clips.

SUMMARY OF THE INVENTION

In this invention, the distribution terminal block has a plurality of bases. Each of the bases has a platform and two lateral sides on opposite edges of the platform. Mating connectors are on each of the lateral sides of the bases for securing a number of the bases together, in side-by-side relation. The bases can thus be assembled to a desired number to match the number of twisted-pairs of wires from the incoming telephone cable.

Each of the bases has three electrically conductive penetrators extending through the platform. Two of the penetrators have downwardly extending terminal ends for connection to a twisted-pair of wires of the incoming telephone cable. The third penetrator is connected to a ground. A module may be secured to each of the bases over the platform. Each module has a pair of electrical contacts, preferably IDC clips. Each clip engages one of the penetrators when the module is secured to the base. Each of the modules has a pair of holes adjacent to the IDC clips for receiving ends of the drop wires. An actuator for each of the modules presses the drop wires into engagement with the IDC clips.

In the preferred embodiment, each of the actuators has a plunger for pushing the drop wires into engagement with the IDC clips. The plunger moves relative to the housing of the module while the module remains stationary on the base. Rotating a screw in one direction causes the plunger to move toward the base. Rotating the screw in the opposite direction causes the plunger to move away from the base.

The plunger has an upper portion and a lower portion separated by a recess and connected by a spine. The upper portion has a larger cross-sectional area than the lower portion. The upper portion has lateral edges that engage guides in the housing to prevent rotation of the plunger. The power portion has a lesser width and beveled corners on its lower lateral edges. The spine joins to the rearward side of the lower portion and has a tapered inner edge that is oblique to the axis of the plunger, thereby defining a sharp point.

It is to be understood that both the foregoing general description and the following detailed description are exemplary and explanatory and are intended to provide further explanation of the invention as claimed. The accompanying drawings are included to provide a further understanding of the invention and are incorporated in and constitute a part of this specification, illustrate one or several embodiments of the invention, and, together with the description, serve to explain the principles of the invention.

DETAILED DESCRIPTION OF THE PREFERRED EMBODIMENTS

Figure 1:
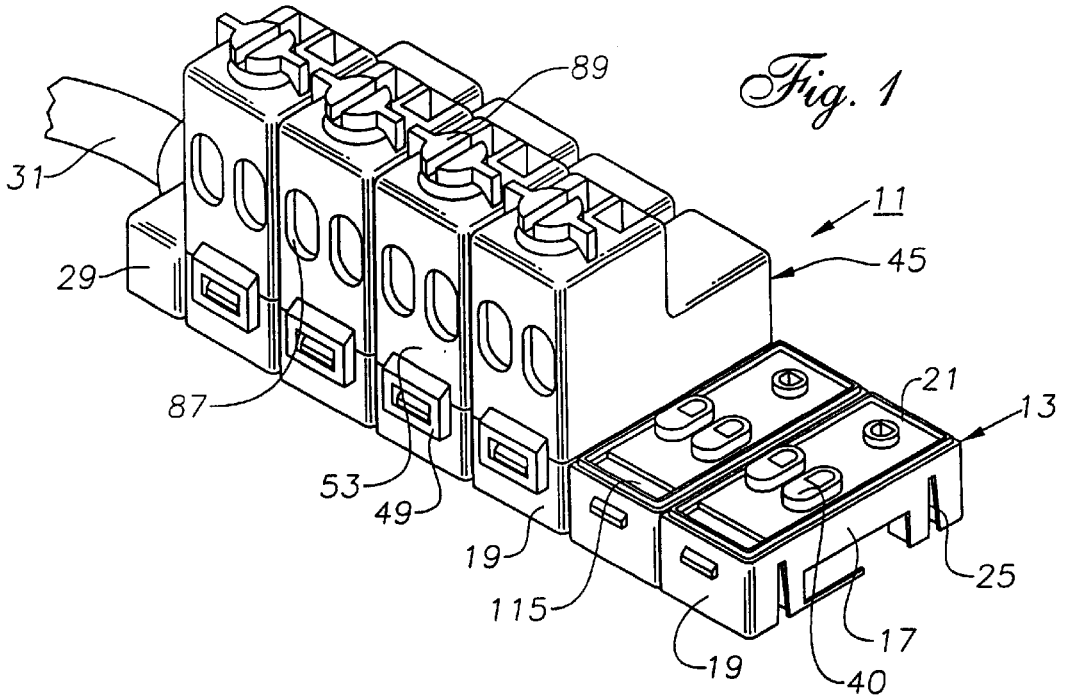
FIG. 1 is a perspective view showing a distribution terminal block constructed in accordance with the invention.
Figure 2:
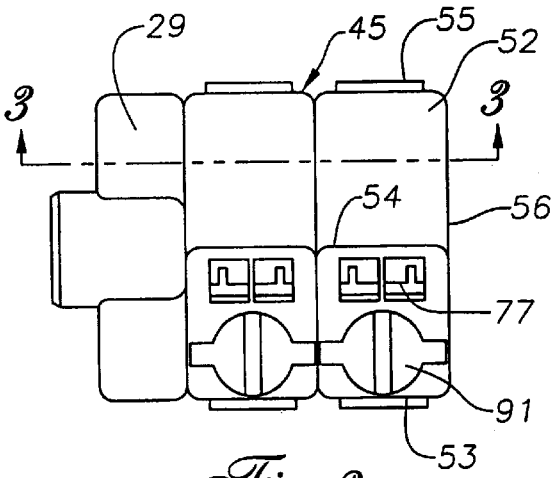
FIG. 2 is a top view of the terminal block of FIG. 1, but showing only two of the modules.
Figure 4:
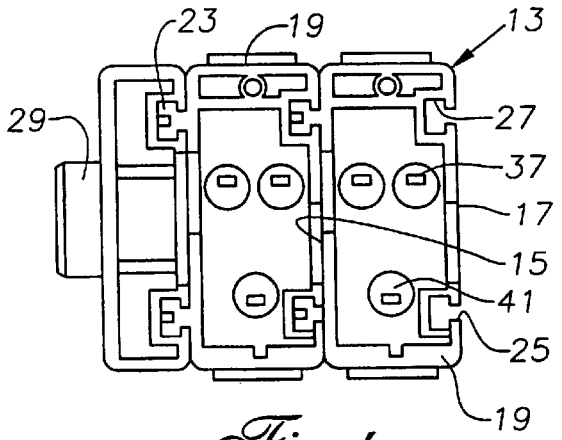
FIG. 4 is a bottom view of the terminal block of FIG. 2.
Figure 3:
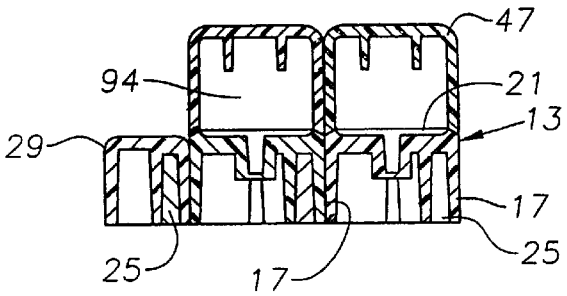
FIG. 3 is a sectional view of the terminal block of FIG. 2, taken along the line 3—3 of FIG. 2.

Referring to FIG. 1, distribution terminal block 11 has a plurality of bases 13. In the drawing, six bases 13 are shown, but the number of bases 13 can be varied depending on the number of twisted-pairs of wires from an incoming telephone cable 31. Referring also to FIG. 4, each base 13 has lateral walls 15, 17 and end walls 19. Each base 13 is generally rectangular, with lateral walls 15, 17 being perpendicular to end walls 19. A flat platform 21 forms a top of each base 13, platform 21 being perpendicular to lateral walls 15, 17 and end walls 19. A lip 22 is provided on base 13 around the entire perimeter of platform 21 for sealing the base 13 from water and other undesirable environmental effects, as will be described.

Figure 5:
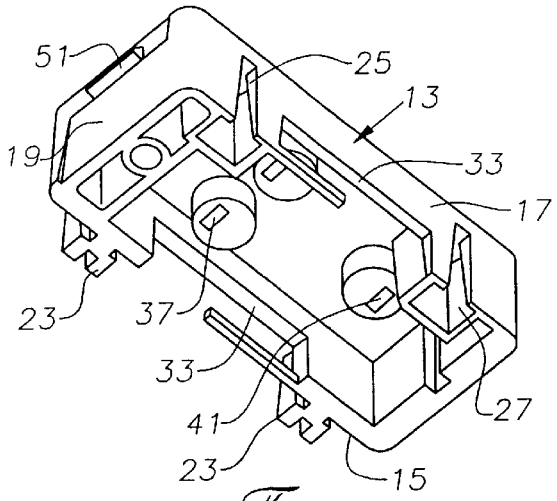
FIG. 5 is a bottom perspective view of one of the bases of the terminal block of FIG. 1.

Referring also to FIG. 5, two connector lugs 23 are formed on lateral wall 15 and extend laterally outward therefrom. Two connector slots 25 are formed in lateral wall 17 opposite lugs 23. Each slot 25 extends from the lower edge of wall 17 and converges in the direction of platform 21. A separate rectangular cavity 27 is located on the inner side of lateral wall 17 in registry with each slot 25. Slot 25 and cavity 27 are adapted to receive one of the lugs 23 from an adjacent base 13. Bases 13 are connected together by sliding lugs 23 into engagement with the slots 25 of the adjacent base 13, so that the friction between lugs 23 and cavities 27 retains the bases 13 together.

Referring again to FIG. 1, a wire feed 29 is located on one of the ends of terminal block 11 for feeding the incoming telephone cable 31, which in the embodiment shown, contains a predetermined number of twisted-pairs of wires. Closure members (not shown) may be inserted into slots 25 on the exposed unused lateral side 17 of the outermost base 13. The twisted-pairs of wires of distribution cable 31 extend within the hollow bases 13, passing through recesses 33 (FIGS. 5, 6) formed in each of the lateral walls 15, 17. The twisted-pairs of wires contained in distribution cable 31 are separately pre-wired and connected to each of the bases 13.

Figure 6:
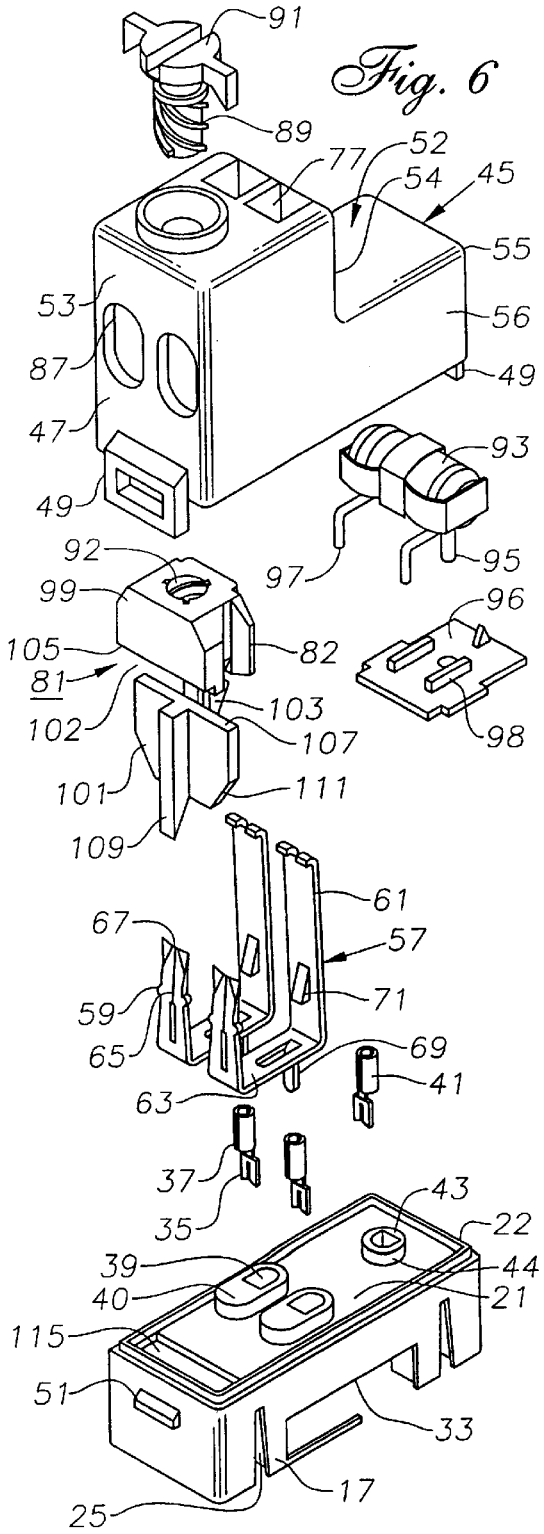
FIG. 6 is an exploded perspective view of one of the modules and one of the bases of the terminal block of FIG. 1.
Figure 7:
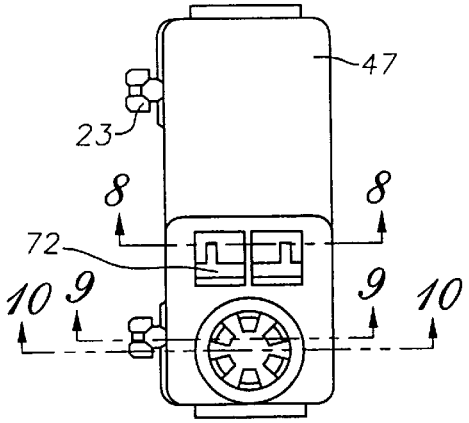
FIG. 7 is a top view one of the modules and one of the bases of the terminal block of FIG. 1.

Each incoming wire will be connected to a terminal 35 of a penetrator 37 that extends downwardly through a hole 39 formed in each platform 21, as best shown in FIG. 6. Each hole 39 extends through a boss 40 that is raised above platform 21. A separate penetrator 37 is provided for each of the wires of the twisted-pair. In particular, one of the penetrators 37 is provided for the wire known as the tip wire, and the other penetrator 37 is provided for the ring wire. Also, a third penetrator 41 is provided for a ground wire. Each penetrator 37, 41 has an upward facing socket. Ground penetrator 41 extends downwardly through a hole 43 formed in platform 21 of base 13. Hole 43 extends through a boss 44 that is raised above platform 21. Bosses 40 and 44 extend to about the same height as lip 22 and serve to prevent water and other undesirable environmental effects that may enter the terminal block 11 from entering holes 39 and 43.

A module 45 attaches to each of the bases 13. Each module 45 includes a housing 47 that has a lower end with a rectangular lower perimeter for tightly and closely engaging base 13 around lip 22 of platform 21. Latch members 49 on housing 47 engage shoulders 51 (FIG. 6) provided on end walls 19 of each base 13. Each latch 49 is flexible and resilient and depends from a lower edge of housing 47, one from a forward end wall 53 and the other from a rearward lower end wall 55. Forward end wall 53 has a greater axial dimension than rearward lower end wall 55 in the embodiment shown. A rearward upper end wall 54 is parallel with rearward lower end wall 55, but forward of it and connected by a step portion 52. The words "forward," "rearward," "lower," "upper," "inner," and "outer" are used only for convenience and not in a limiting manner. Module housing 47 further has two lateral side walls 56 that are perpendicular to forward end wall 53 and to rearward upper and lower end walls 54, and 55.

A pair of electrically conductive IDC clips 57 are located within each housing 47. Each clip 57 has a generally J-shaped configuration, having a short forward leg 59, a longer rearward leg 61 and a flat base 63 that joins legs 59, 61. Base 63 will be parallel to platform 21 once module 45 is installed. Forward leg 59 has an axial slit 65 that defines a pair of sharp edges biased toward each other. A slightly concave entry edge 67 is located at the upper end of slit 65. When an insulated wire is placed on entry edge 67 and pressed downward toward platform 21, the sharp edges of slit 65 will cut the insulation and create electrical continuity with IDC clip 57. A prong 69 depends from base 63 and locates in one of the sockets of one of the penetrators 37. Electrical continuity between one of the twisted-pairs of wires from incoming telephone cable 31 (FIG. 1) is thus established through terminal 35, penetrator 37 and IDC clip 57.

Figure 8:
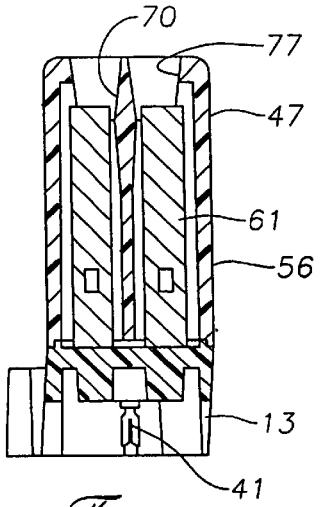
FIG. 8 is a sectional view of the module and base of FIG. 7, taken along the line 8—8 of FIG. 7.
Figure 12:
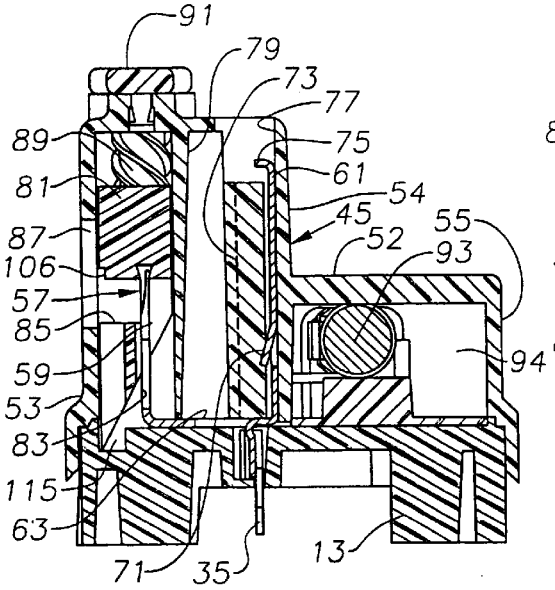
FIG. 12 is a sectional view of the module and base of FIG. 11, taken along the line 12—12 of FIG. 11, and shown in a closed position.
Figure 13:
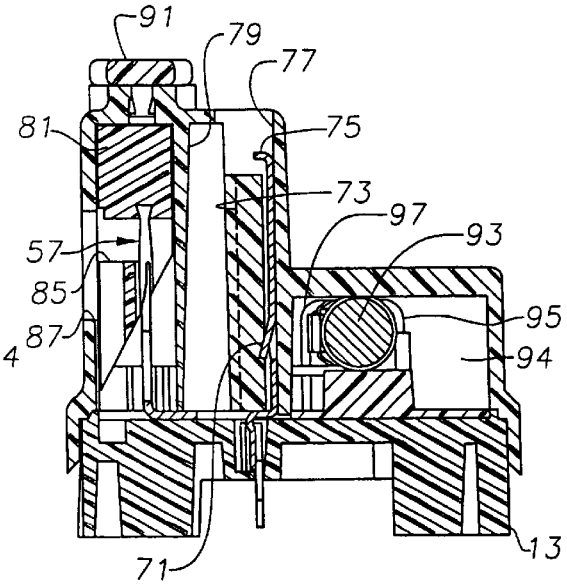
FIG. 13 is the same sectional view as FIG. 12, but showing the actuator in an open position.

Rearward legs 61 of IDC clips 57 are separated by a central divider partition 70 (FIGS. 8, 14) within housing 47. Divider partition 70 is parallel with lateral side walls 56 of module 45 and extends forward from rearward upper end wall 54 to a partition 73 (FIGS. 12, 13). Partition 73 is spaced forward of upper rearward end wall 54. Partition 73 extends laterally from one lateral wall 56 to the other, parallel with rearward upper end wall 54. The thickness of partition 73 is shown by the dotted lines in FIGS. 12 and 13. The sectional planes of FIGS. 12 and 13 are taken through ribs that protrude rearwardly from partition 73.

Referring still to FIGS. 12 and 13, rearward leg 61 of IDC clip 57 has a tab 71 that is bent in a forward direction for retaining IDC clip 57 in housing 47. Tab 71 engages a notch located on one of the ribs of partition 73. Referring still to FIGS. 12 and 13, each IDC clip 57 has an upper end 75 that extends above partition 73 and is exposed to an access port 77 extending downwardly from the top of housing 47. Access port 77 enables one to test continuity of the electrical connection made by module 45 without removing module 45 from base 13.

Figure 10:
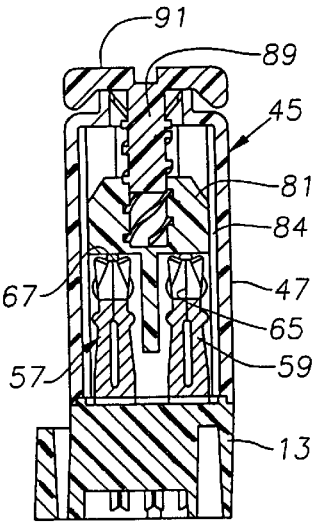
FIG. 10 is a sectional view of the module and base of FIG. 7, taken along the line 10—10 of FIG. 7.

As best shown in FIGS. 12 and 13, a pair of guide ribs 79 are formed on the interior of each lateral side wall 56 forward of partition 73. Guide ribs 79 protrude from the interiors of lateral side walls 56 a short distance. A plunger 81 is located forward of guide ribs 79 in a plunger cavity between guide ribs 79 and forward wall 53. Plunger 81 moves reciprocally along a vertical plunger axis relative to housing 47. Plunger 81 is shown in an upper open position in FIG. 13 and a lower closed position in FIG. 12. Plunger 81 is prevented from rotation relative to housing 47 by guide ribs 79 and further by rib 84 (FIG. 10) located forward of guide rib 79 (FIGS. 12, 13) on each side wall 56. As shown in FIG. 6, plunger 81 has guide ribs 82 that engage the slot located between guide ribs 79 (FIGS. 12, 13) and rib 84 (FIG. 10). Guide ribs 82 are located on both sides of plunger 81.

Plunger 81 has an upper portion 99 and a lower portion 101. Upper and lower portions 99, 101 are separated from each other by a recess 102 that extends from one lateral edge to the other of plunger 81. A spine 103 connects the upper and lower portions 99, 101. Recess 102 is defined by a downward facing shoulder 105 on the lower edge of upper portion 99 and an opposed upward facing shoulder 107 on the upper edge of lower portion 101. Shoulders 105, 107 are parallel to each other in the embodiment shown. Upper shoulder 105 has a notch 106 (FIGS. 12, 14) that extends across the full width of upper portion 99 on the forward side. As the drop wires are inserted through the forward end wall 53, they contact shoulder 105, which presses the drop wires into the leg 59 of IDC clips 57.

The notch 106 provides a space that allows an insulating gel to fully surround the drop wires between the forward end wall 53 and the upper portion 99, thereby effectively sealing the entrance to the terminal block 11 from water and other undesirable environmental effects. If the upper portion 99 were square rather than having an undercut, such as notch 106, it is possible that there would be no insulating gel between the wire and the upper portion 99. Thus, water running along the drop wire would be permitted to enter the module 45 because of a lack of insulating gel on the top of the drop wire. Although notch 106 is shown as a rectangular recess, it could also be an angular chamfer, or any other shape (e.g., curvilinear) that allows a space between the drop wire and the upper portion 99 of the plunger 81.

Figure 14:
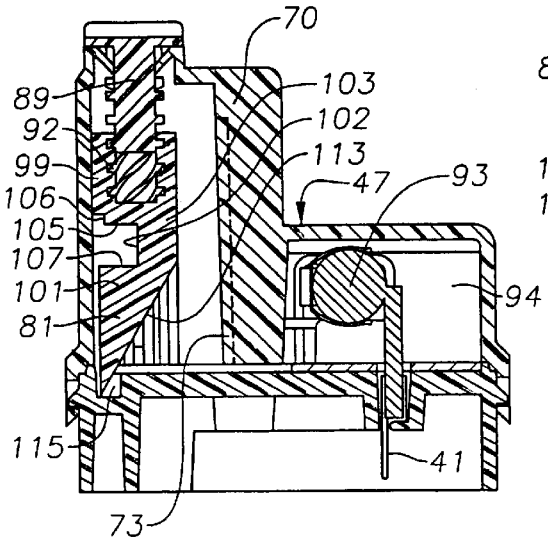
FIG. 14 is a sectional view of the module and base of FIG. 11, taken along the line 14—14 of FIG. 11, and showing the actuator in a closed position.
Figure 15:
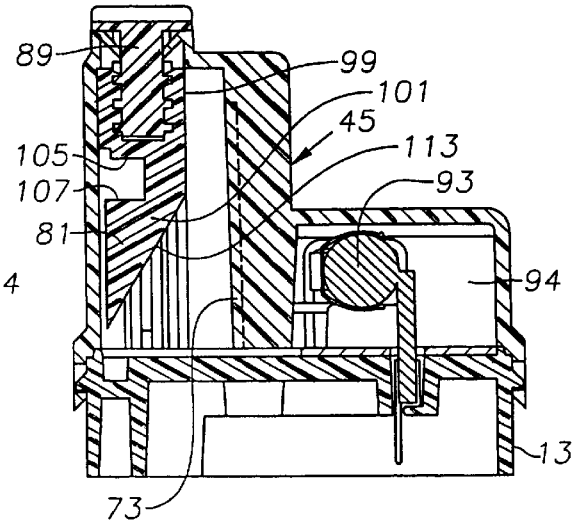
FIG. 15 is the same sectional view as FIG. 14, but showing the actuator in an open position.

Spine 103 is integrally formed with upper and lower portions 99, 101, and joins lower portion 101 on a rearward side. Spine 103 extends downward to the lower edge of lower portion 101. Spine 103 is a generally flat member located in a plane perpendicular to housing forward end wall 53. Spine 103 has a lower edge 113 that is formed on a diagonal line oblique to the plunger 81, as shown in FIGS. 14 and 15. This defines an angled, sharp point on the lower edge of plunger 81 to reduce disturbance to the insulating gel as plunger 81 moves inward.

Lower portion 101 has a forward side with a generally flat portion that is parallel with the forward end wall 53 of housing 47. A rib 109 protrudes from this flat portion. Rib 109 is in the same plane with spine 103 and joins the sharp tip of spine 103. Furthermore, the forward side of lower portion 101 has beveled corners 111 at the intersection of the forward side with its two lateral sides.

Figure 9:
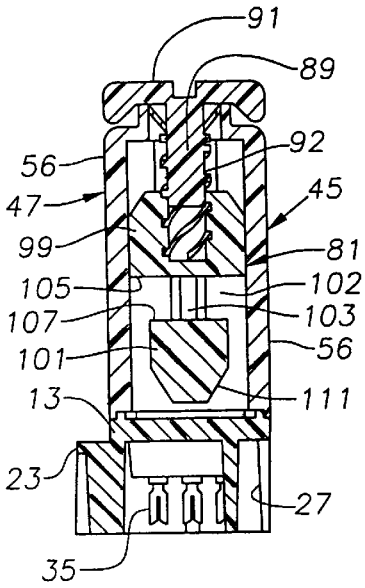
FIG. 9 is a sectional view of the module and base of FIG. 7, taken along the line 9—9 of FIG. 7.
Figure 11:
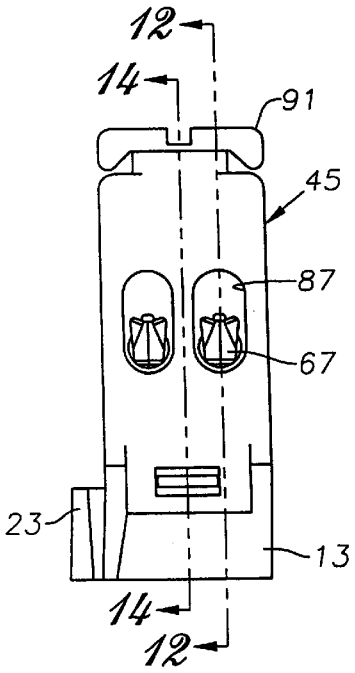
FIG. 11 is a front view of one of the modules and one of the bases of the terminal block of FIG. 1.

Lower portion 101 has a cross-sectional area in a plane perpendicular to the plunger axis that is significantly smaller than the cross-sectional area of upper portion 99. The width of lower portion 101 also is preferably less than the width of upper portion 99, thereby creating gaps between its lateral sides and housing side walls 56, as shown in FIG. 9. Spine 103 has a considerably smaller cross-sectional area than lower portion 101. These features cooperate with the oblique lower edge 113 of spine 103 and the beveled comers 111 to reduce disturbance to the insulating gel as plunger 81 is moving inward. Recess 102 of plunger 81 registers with a pair of elongated holes 87 formed in forward end wall 53. Each hole 87 has an axial length that is more than twice its width. Each hole 87 will register with recess 102 both in the upper and the lower positions as can be seen in FIGS. 11–13.

Preferably, a rotary member moves plunger 81 between the upper (open) and the lower (closed) positions. The rotary member is preferably a screw 89 having a helical thread with multiple starts. Screw 89 has a head 91 located on the upper end of housing 47 and engages mating threads 92 (FIG. 14) formed in a receptacle in plunger 81. Rotation of less than one turn will stroke plunger 81 filly from the open to the closed position. Moving plunger 81 to the lower position causes its lower tip to enter a recess 115 (FIG. 12) in platform 21 (FIG. 1).

Module 45 may optionally be provided with a protector 93, which will be mounted in a rearward cavity 94 separate and rearward from the cavity containing IDC clips 57 and plunger 81. The cavity containing IDC clips 57 and plunger 81 is filled with the insulating gel, but cavity 94 does not contain the insulating gel. Protector 93 is a commercially available electrical device for protecting equipment against high or excessive voltage, such as caused by lightning strikes. Protector 93 has two contacts (not shown) spaced apart by an insulation gap, which is bridged if the voltage applied is high enough. Protector 93 has a ground leg 95 and tip and ring legs 97. Ground leg 95 joins ground penetrator 41 (FIG. 6). Tip and ring legs 97 are electrically connected with IDC clips 57, preferably by soldering. Penetrators 37 are connected to tip and ring wires from the provider. Excessive voltage applied to either of the penetrators 37 will discharge through protector 93 to ground through penetrator 41. A snap-in floor 96 (FIG. 6) fits in the base of step portion 52. The snap-in floor 96 has a pair of upright supports 98 that provide support for protector 93.

In operation, terminal block 11 will be assembled by connecting a selected number of bases 13 to each other with lugs 23 locating within slots 25 (FIGS. 5, 6). Preferably, enough bases 13 will be assembled to match the capacity of the incoming telephone company distribution cable 31. The twisted-pairs of wires within incoming cable 31 will be pre-wired to each of the bases 13 by connecting each of the wires to the various penetrators 37 and by connecting each penetrator 41 to a common ground wire that is part of the incoming cable 31. Then, a number of modules 45, each preferably filled with insulating gel as described above, will be snapped onto the bases 13 using latches 49. When modules 45 are placed on bases 13, the prongs 69 of each of the IDC clips 57 will engage penetrators 37. If a protector 93 is used, ground leg 95 will enter the socket of penetrator 41 and protector 93 will locate on hole 43. Some of the bases 13, even though pre-wired with twisted-pairs of wires from incoming cable 31, may be left unused without any module 45 until needed.

To install individual drop lines, the tip and ring wires are inserted into holes 87 and into recess 102 while plunger 81 is in the open position shown in FIG. 13. This places each wire directly above the entry edge 67 of each slit 65 (FIG. 6) of each IDC clip 57. Screw 89 is then rotated, which strokes plunger 81 toward base 13. The downward facing shoulder 105 of plunger 81 presses the drop wires downward through the slits 65, cutting the insulation and establishing electrical continuity between the drop wires and legs 59 of IDC clips 57. During the inward movement, upper portion 99 pushes insulating gel contained in housing 47 inward, thereby assuring that the gel surrounds IDC clips 57. The lower portion 101 will not push any significant amount of the insulating gel because of its thin profile and angled, sharp end, reducing a tendency to push the insulating gel away from the base of IDC clips 57.

Continuity to the twisted-pairs of wires of incoming cable 31 (FIG. 1) is established through penetrators 37. The continuity may be checked by using the rearward legs 61 of IDC clips 57 and access ports 77 provided in housing 47 of module 45. Additional modules 45 may be added at any time. To remove the wires, screw 89 is rotated in the opposite direction. Upward facing shoulder 107 of lower portion 101 presses the drop wires upward out of slits 65 (FIG. 6) of IDC clips 57. Very little, if any of the insulating gel is pushed out apertures 87 because of the thin profile of lower portion 101 of plunger 81. Accordingly, reinsertion of the drop wires can be made without re-introducing the insulating gel into housing 47.

The invention has significant advantages. The configuration of the plunger enhances immersion of the IDC clips in insulating gel and reduces disturbance of the insulating gel both on inward movement and on reinsertion. The upper portion of the plunger pushes the insulating gel inward, while the lower portion of the plunger slices through the insulating gel with minimal disturbance.

While the invention has been shown in only one of its forms, it should be apparent to one skilled in the art that it is not so limited, but is susceptible to various changes without departing from the scope of the invention.

That which is claimed is:

1. A module for connecting drop wires to wires of an incoming telephone cable, the module attached to a base having electrical contacts electrically connected to the wires of the incoming telephone cable, the module comprising:

a housing attached to the base, the housing having a cavity therein filled with an insulating gel and a pair of holes for receiving the drop wires in the cavity;

a pair of electrically conductive connectors located within the cavity of the housing, each of the connectors comprising an extension for engaging one of the electrical contacts when the module is attached to the base, each of the connectors having an axial slit with opposed sharp edges biased toward each other; and a plunger located within the cavity of the housing, the plunger defining a plunger axis and being movable along the plunger axis between an open position for receiving the drop wires in the cavity and a closed position for electrically connecting the drop wires to the connectors, the plunger having an upper portion and a lower portion connected by a spine and separated by a recess for receiving the drop wires between the upper portion and the lower portion in the open position.

2. The module according to claim 1 wherein the upper portion comprises a lower edge and a downward facing shoulder adjacent the lower edge for pressing the drop wires into electrical continuity with the connectors while the plunger moves from the open position to the closed position; and wherein the lower portion comprises an upward facing shoulder opposite the downward facing shoulder of the upper portion for pressing the drop wires out of electrical continuity with the connectors while the plunger moves from the closed position to the open position; and wherein the recess is defined by the downward facing shoulder of the upper portion and the upward facing shoulder of the lower portion.

3. The module according to claim 2 wherein the shoulder of the upper portion of the plunger has a notch formed therein that provides a space for allowing the insulating gel to fully surround the drop wires and thereby effectively seal the pair of holes in the housing from water and undesirable environmental effects.

4. The module according to claim 3 wherein the housing comprises a pair of lateral side walls, a forward end wall perpendicular to the lateral side walls and a rearward end wall parallel to the forward end wall and perpendicular to the lateral side walls; and wherein the notch of the shoulder of the upper portion of the plunger is located between the forward end wall of the housing and the spine adjacent the forward end wall.

5. The module according to claim 1 wherein the lower portion of the plunger has a pair of lateral sides and a maximum width measured between the pair of lateral sides and the upper portion of the plunger has a pair of lateral sides and a minimum width measured between the pair of lateral sides and wherein the maximum width of the lower portion is less than the minimum width of the upper portion to reduce disturbance of the insulating gel while the plunger moves between the open position and the closed position.

6. The module according to claim 1 wherein the lower portion of the plunger has a cross-sectional area and the upper portion of the plunger has a cross-sectional area that is greater than the cross-sectional area of the lower portion of the plunger to reduce disturbance of the insulating gel while the plunger moves between the open position and the closed position; and wherein the spine of the plunger has a cross-sectional area that is substantially less than the cross-sectional area of the lower portion of the plunger to reduce disturbance of the insulating gel while the plunger moves between the open position and the closed position.

7. The module according to claim 1 wherein the lower portion of the plunger comprises beveled comers to reduce disturbance of the insulating gel while the plunger moves between the open position and the closed position.

8. The module according to claim 1 wherein the spine of the plunger is connected to a rearward side of the lower portion of the plunger and comprises a lower edge extending at an oblique angle relative to the plunger axis and thereby defines an angled, sharp point on the lower edge to reduce disturbance of the insulating gel while the plunger moves between the open position and the closed position.

9. The module according to claim 1 wherein the housing has opposed lateral interior walls and comprises a pair of axially extending guide ribs formed thereon adjacent the cavity of the housing; and wherein the upper portion of the plunger engages the guide ribs of the housing to prevent rotation of the plunger relative to the housing; and wherein the lower portion of the plunger has lateral sides that are spaced apart from the guide ribs of the housing to reduce disturbance of the insulating gel while the plunger moves between the open position and the closed position.

10. The module according to claim 1 wherein the base comprises a platform having a perimeter and a lip around the entire perimeter of the platform for tightly and closely engaging the housing to prevent water and undesirable environmental effects from entering the base and the housing.

11. The module according to claim 1 wherein the base comprises a platform and a plurality of bosses are provided on the base to prevent water and undesirable environmental effects from entering the base.

12. A module for connecting drop wires to wires of an incoming telephone cable, the module attached to a base having electrical contacts electrically connected to the wires of the incoming telephone cable, the module comprising:

a housing attached to the base, the housing having a cavity therein filled with an insulating gel and a pair of holes for receiving the drop wires in the cavity;

a pair of electrically conductive IDC clips located within the cavity of the housing, each of the IDC clips comprising a penetrator for engaging one of the electrical contacts when the module is attached to the base, each of the IDC clips having an axial slit with opposed sharp edges biased toward each other; and a plunger located within the cavity of the housing, the plunger defining a plunger axis and being movable along the plunger axis between an open position for receiving the drop wires in the cavity and a closed position for electrically connecting the drop wires to the connectors, the plunger having an upper portion and a lower portion connected by a spine and separated by a recess for receiving the drop wires between the upper portion and the lower portion in the open position.

13. The module according to claim 12 wherein the upper portion comprises a lower edge and a downward facing shoulder adjacent the lower edge for pressing the drop wires into electrical continuity with the IDC clips while the plunger moves from the open position to the closed position; and wherein the lower portion comprises an upward facing shoulder opposite the downward facing shoulder of the upper portion for pressing the drop wires out of electrical continuity with the IDC clips while the plunger movies from the closed position to the open position; and wherein the recess is defined by the downward facing shoulder of the upper portion and the upward facing shoulder of the lower portion.

14. The module according to claim 13 wherein the shoulder of the upper portion of the plunger has a notch formed therein that provides a space for allowing an insulating gel to fully surround the drop wires and thereby effectively seal the pair of holes in the housing from water and undesirable environmental effects.

15. The module according to claim 14 wherein the housing comprises a pair of lateral side walls, a forward end wall perpendicular to the lateral side walls and a rearward end wall parallel to the forward end wall and perpendicular to the lateral side walls; and wherein the notch of the shoulder of the upper portion of the plunger is located between the forward end wall of the housing and the spine adjacent the forward end wall.

16. The module according to claim 12 wherein the lower portion of the plunger has a pair of lateral sides and a maximum width measured between the pair of lateral sides and the upper portion of the plunger has a pair of lateral sides and a minimum width measured between the pair of lateral sides and wherein the maximum width of the lower portion is less than the minimum width of the upper portion to reduce disturbance of the insulating gel while the plunger moves between the open position and the closed position.

17. The module according to claim 12 wherein the lower portion of the plunger has a cross-sectional area and the upper portion of the plunger has a cross-sectional area that is greater than the cross-sectional area of the lower portion of the plunger to reduce disturbance of the insulating gel while the plunger moves between the open position and the closed position; and wherein the spine of the plunger has a cross-sectional area that is substantially less than the cross-sectional area of the lower portion of the plunger to reduce disturbance of the insulating gel while the plunger moves between the open position and the closed position.

18. The module according to claim 12 wherein the lower portion of the plunger comprises beveled corners to reduce disturbance of the insulating gel while the plunger moves between the open position and the closed position.

19. The module according to claim 12 wherein the spine of the plunger is connected to a rearward side of the lower portion of the plunger and comprises a lower edge extending at an oblique angle relative to the plunger axis and thereby defines an angled, sharp point on the lower edge to reduce disturbance of the insulating gel while the plunger moves between the open position and the closed position.

20. The module according to claim 12 wherein the housing has opposed lateral interior walls and comprises a pair of axially extending guide ribs formed thereon adjacent the cavity of the housing; and p1 wherein the upper portion of the plunger engages the guide ribs of the housing to prevent rotation of the plunger relative to the housing; and wherein the lower portion of the plunger has lateral sides that are spaced apart from the guide ribs of the housing to reduce disturbance of the insulating gel while the plunger moves between the open position and the closed position.

21. The module according to claim 12 wherein the base comprises a platform having a perimeter and a lip around the entire perimeter of the platform for tightly and closely engaging the housing to prevent water and undesirable environmental effects from entering the base and the housing.

22. The module according to claim 12 wherein the base comprises a platform and a plurality of bosses are provided on the base to prevent water and undesirable environmental effects from entering the base.

* * * * *

UNITED STATES PATENT AND TRADEMARK OFFICE

CERTIFICATE OF CORRECTION

PATENT NO. : 6,299,475 B1
DATED : October 9, 2001
INVENTOR(S) : Paul J. Huspeni; Richard B. Laporte; Elmor O. Freeman; Ziwei Liu; and Antonio P. Rodriguez, Jr.

It is certified that error appears in the above-identified patent and that said Letters Patent is hereby corrected as shown below:

Column 10,
Line 32, delete "p1".

Signed and Sealed this

Nineteenth Day of March, 2002

*Attest:*

*Attesting Officer*

JAMES E. ROGAN
*Director of the United States Patent and Trademark Office*